US009291973B2

(12) United States Patent
Kakutani et al.

(10) Patent No.: US 9,291,973 B2
(45) Date of Patent: Mar. 22, 2016

(54) IMAGE FORMING APPARATUS FOR PERFORMING COLOR REGISTRATION CONTROL BASED ON DETECTION RESULT OF PATCH IMAGE

(71) Applicant: CANON KABUSHIKI KAISHA, Tokyo (JP)

(72) Inventors: Toshifumi Kakutani, Abiko (JP); Shinya Suzuki, Toride (JP); Ryosuke Nanai, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 13/693,461

(22) Filed: Dec. 4, 2012

(65) Prior Publication Data

US 2013/0164047 A1 Jun. 27, 2013

(30) Foreign Application Priority Data

Dec. 27, 2011 (JP) ..... 2011-286622

(51) Int. Cl.
*G03G 15/01* (2006.01)
*G03G 15/00* (2006.01)

(52) U.S. Cl.
CPC ..... *G03G 15/5033* (2013.01); *G03G 15/0189* (2013.01); *G03G 15/5058* (2013.01); *G03G 2215/0161* (2013.01)

(58) Field of Classification Search
CPC ..... G03G 15/5033
See application file for complete search history.

(56) References Cited

U.S. PATENT DOCUMENTS 5,678,132 A * 10/1997 Shiba ..... G03G 15/5058 399/59
7,206,531 B2 4/2007 Suzuki et al.
7,209,673 B2 4/2007 Suzuki et al.
2003/0214568 A1* 11/2003 Nishikawa ..... B41J 29/393 347/116
2004/0165025 A1* 8/2004 Ishibashi ..... H04N 1/00002 347/19
2009/0162112 A1* 6/2009 Murayama ..... H04N 1/58 399/301

(Continued)

FOREIGN PATENT DOCUMENTS

JP 06060181 A * 3/1994
JP 10-260567 A 9/1998

(Continued)

OTHER PUBLICATIONS

JP_2007310322_A_H Machine Translation.*

(Continued)

*Primary Examiner* — Clayton E LaBalle
*Assistant Examiner* — Victor Verbitsky
(74) *Attorney, Agent, or Firm* — Fitzpatrick, Cella, Harper & Scinto

(57) ABSTRACT

An image forming apparatus includes: an image carrier on which images formed by a plurality of image forming units are transferred; a sensor configured to irradiate the image carrier with light, and detect reflected light; a detection unit configured to detect, based on an output value of the sensor, a feature value of an edge of a patch image which has been formed by the image forming unit and transferred to the image carrier; a determination unit configured to determine a position of the patch image using the output value of the sensor corresponding to the patch image and the feature value of the edge; and a color registration control unit configured to perform color registration control based on the determined position of the patch image.

4 Claims, 12 Drawing Sheets

(56) References Cited

U.S. PATENT DOCUMENTS

| | | | | |
|---|---|---|---|---|
| 2010/0238465 | A1* | 9/2010 | Kageyama | G03G 15/0194 358/1.9 |
| 2011/0052231 | A1* | 3/2011 | Kitao | G03G 15/0131 399/49 |
| 2012/0038731 | A1 | 2/2012 | Takahashi et al. | |
| 2013/0164006 | A1 | 6/2013 | Suzuki | |

FOREIGN PATENT DOCUMENTS

| | | | |
|---|---|---|---|
| JP | 2007310322 | A * | 11/2007 |
| JP | 2010-48904 | A | 3/2010 |

OTHER PUBLICATIONS

JP_06060181_A_H Machine Translation, Mar. 1994, Japan, Kikuchi.*

* cited by examiner

IMAGE FORMING APPARATUS FOR PERFORMING COLOR REGISTRATION CONTROL BASED ON DETECTION RESULT OF PATCH IMAGE

BACKGROUND OF THE INVENTION

1. Field of the Invention

The present invention relates to a color registration control based on the detection result of a patch image.

2. Description of the Related Art

Conventionally, an image forming apparatus for irradiating a plurality of photosensitive members with a laser beam to form an electrostatic latent image on each photosensitive member, developing each electrostatic latent image by toner of each color, and transferring and superimposing a plurality of toner images on a printing material or the like to form a color image has been used. In this type of image forming apparatus, due to a mechanical arrangement error of each photosensitive member, an error in light path length of a laser beam, or a change in light path length of a laser beam, a position of a printing material where each toner image is transferred may shift, thereby causing color misregistration. To deal with this, such an image forming apparatus forms a patch image for detecting color misregistration; that is, misregistration of toner images with respect to a reference color toner image, calculates an amount of the color misregistration, and corrects the color misregistration.

In a color registration control operation, a patch image is irradiated with light, and an optical sensor detects reflected light to detect the position of the patch image. More specifically, the position of the patch image is detected based on the timing when the light amount of the reflected light becomes larger or smaller than a predetermined threshold. If, therefore, the density of the patch image changes, the detected position of the patch image may become different even though the patch image is at the same position. Referring to FIG. 14, a solid line represents a change in amount of reflected light with time when a high-density patch image is irradiated with light, and a dotted line represents a change in amount of reflected light with time when a low-density patch image is irradiated with light. In FIG. 14, the difference between the densities of the patch images results in a difference Ta1 in the timing when the amount of the reflected light exceeds a threshold. The detected positions of the patch images are also different from each other.

Japanese Patent Laid-Open Nos. 10-260567 and 2010-048904 disclose a technique of stabilizing the density of a position detection patch image by forming a density control patch image before forming the position detection patch image in order to enable stable position detection.

The density is known to be high in the edge portion of a toner image in an image forming apparatus. This phenomenon in which the density is high in the edge of a toner image will be referred to as an edge density variation phenomenon hereinafter. The edge density variation phenomenon varies depending on degradation of a developer, development conditions such as a toner density, and latent image conditions such as a development contrast potential. It is, therefore, generally difficult to control an image forming apparatus so as to prevent the edge density variation phenomenon.

SUMMARY OF THE INVENTION

The present invention reduces errors in detected position of a patch image due to the edge density variation phenomenon, thereby enabling a patch image region to be detected with high accuracy.

According to one aspect of the present invention, an image forming apparatus includes: a plurality of image forming units; an image carrier on which images formed by the plurality of image forming units are transferred; a sensor configured to irradiate the image carrier with light, and detect reflected light; a detection unit configured to detect, based on an output value of the sensor, a feature value of an edge of a patch image which has been formed by the image forming unit and transferred to the image carrier; a determination unit configured to determine a position of the patch image using the output value of the sensor corresponding to the patch image and the feature value of the edge; and a color registration control unit configured to perform color registration control based on the determined position of the patch image.

Further features of the present invention will become apparent from the following description of exemplary embodiments with reference to the attached drawings.

DESCRIPTION OF THE EMBODIMENTS

Embodiments of the present invention will be described in detail below. Note that components which are not necessary for understanding the present invention are omitted from the accompanying drawings to be used in the following description for the sake of simplicity.

(First Embodiment)

Figure 1:
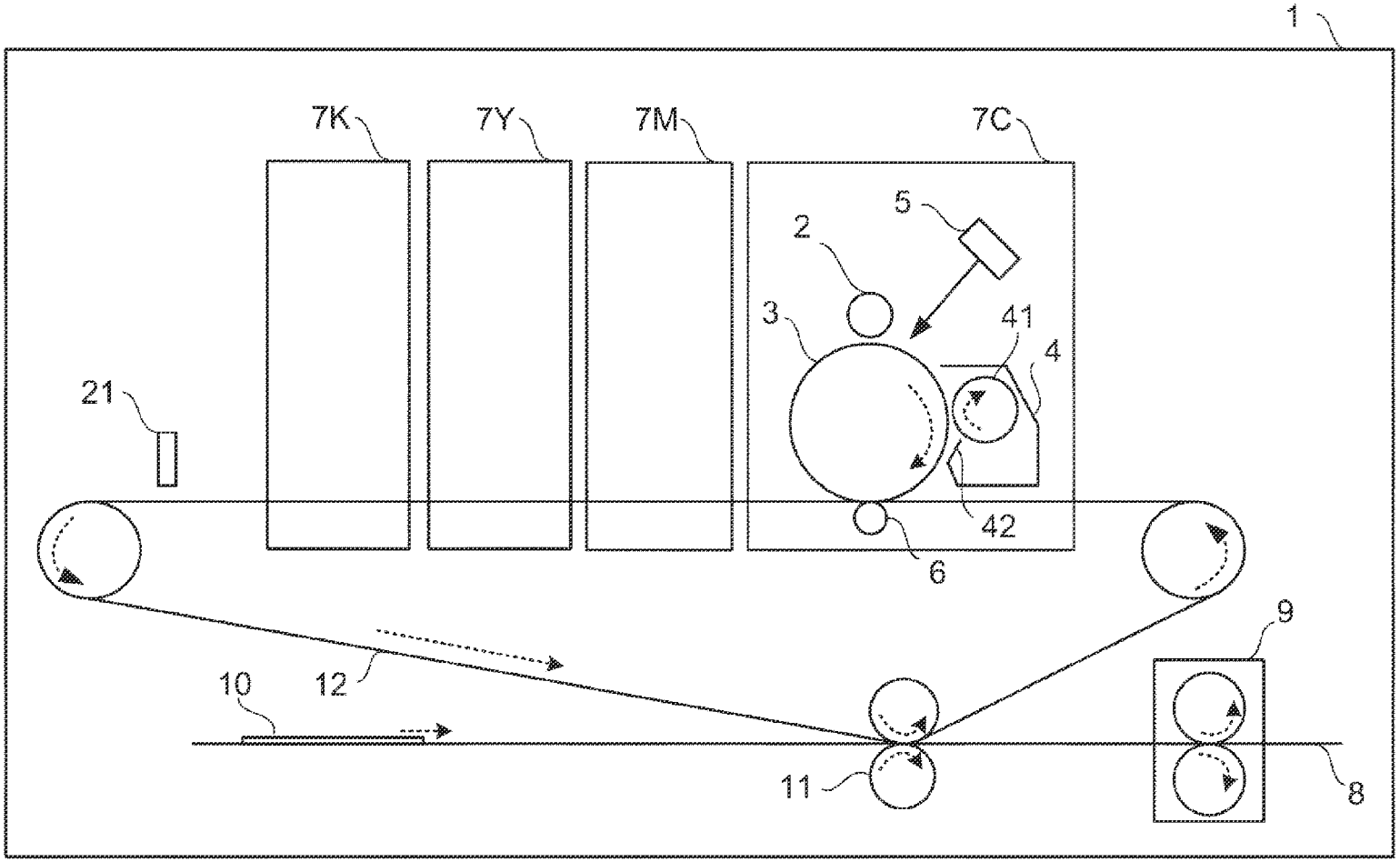
FIG. 1 is a view showing the arrangement of the image forming unit of an image forming apparatus according to an embodiment.

FIG. 1 is a view showing the arrangement of an image forming unit 1 of an image forming apparatus according to the present embodiment. Note that in FIG. 1, each dotted arrow represents the moving direction or rotation direction of each member. Image forming stations 7C, 7M, 7Y, and 7K form cyan, magenta, yellow, and black toner images, and transfer them on an intermediate transfer belt 12 serving as an image carrier, respectively. Note that the arrangements of the image forming stations 7C, 7M, 7Y, and 7K are the same except for toner colors, and only the image forming station 7C will be described below. A photosensitive member 3 serving as an image carrier is charged by a charging device 2, and an exposure device 5 scans the surface of the photosensitive member 3 with a laser beam based on image data indicating an image to be formed, and forms an electrostatic latent image.

A developing device 4 has a developer including toner of a corresponding color, and develops, with the toner, the electrostatic latent image formed on the photosensitive member 3 to form a toner image on the photosensitive member 3. Note that in this embodiment, the developer is a two-component developer obtained by mixing nonmagnetic toner with a corresponding color and magnetic carrier in a predetermined ratio. Note also that the developing device 4 includes a nonmagnetic developing sleeve 41 with a fixed magnet. The developing sleeve 41 is arranged to face the photosensitive member 3 at a closest distance (to keep an S-D gap) while part of the outer peripheral surface is exposed outside the developing device 4. A voltage device (not shown) applies a voltage to the developing sleeve 41. Note that a portion where the photosensitive member 3 faces the developing sleeve 41 will be referred to as a development region hereinafter. In this embodiment, the developing sleeve 41 is rotated and driven in the same direction as the rotation direction of the photosensitive member 3. In this case, a regulation blade 42 is arranged upstream of the rotation direction of the developing sleeve 41 in the development region, and coats the surface of the developing sleeve 41 with the two-component developer to form a thin layer.

A primary transfer device 6 transfers the toner image formed on the photosensitive member 3 to the intermediate transfer belt 12. Note that toner images formed by the image forming stations 7C, 7M, 7Y, and 7K are transferred to the intermediate transfer belt 12, and superimposed on one another, thereby forming a color image. A secondary transfer device 11 transfers the toner images on the intermediate transfer belt 12 to a printing material 10 which is conveyed through a conveyance path 8, and a fixing device 9 fixes the toner images transferred to the printing material 10 by heat and pressure.

Figure 2:
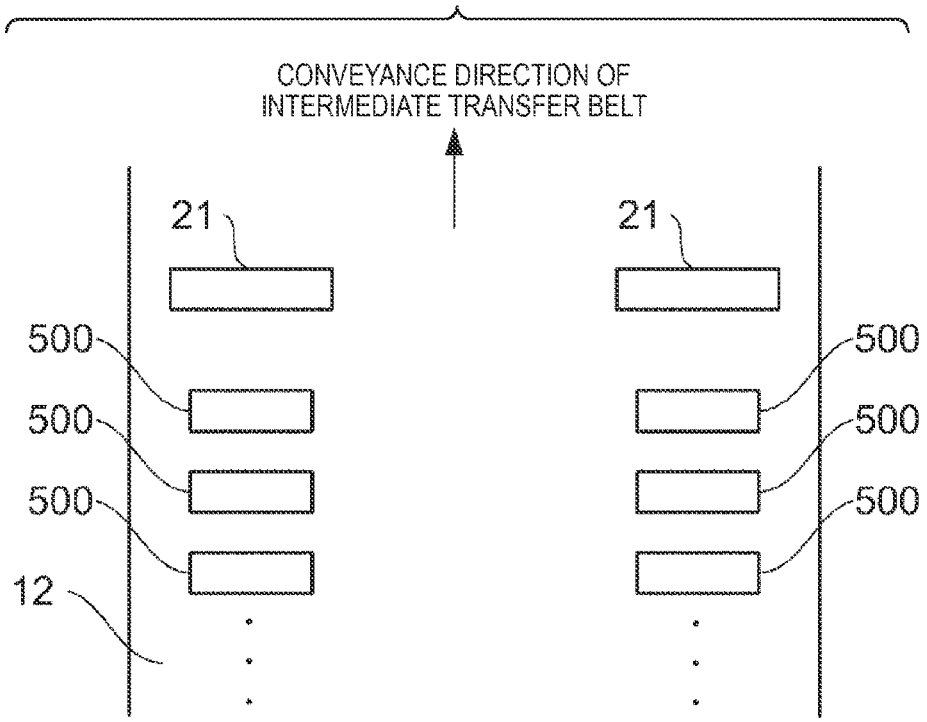
FIG. 2 is a view showing the arrangement of optical sensors.
Figure 3:
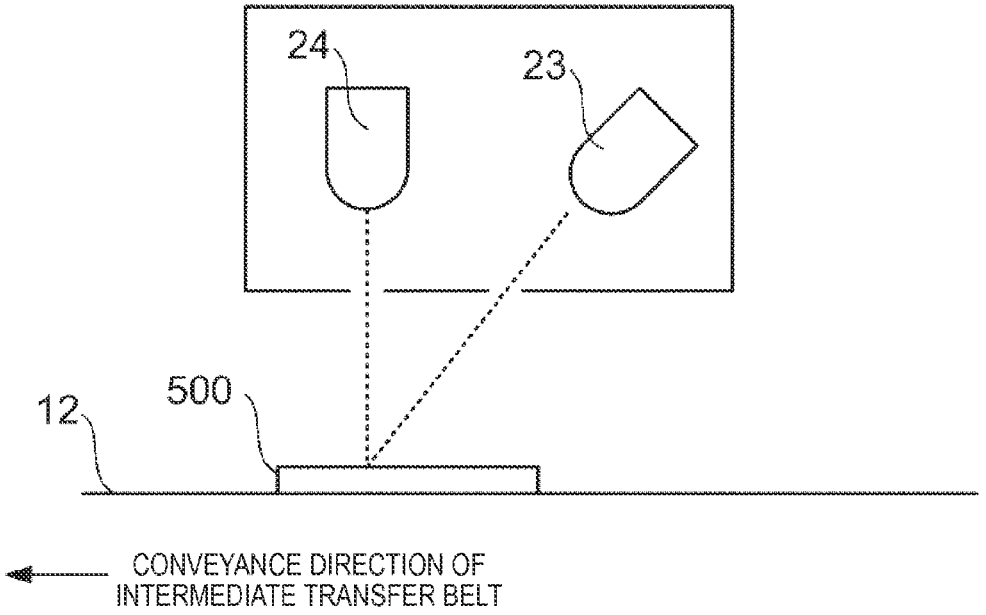
FIG. 3 is a view showing the configuration of the optical sensor.

Furthermore, an optical sensor 21 is arranged to face the intermediate transfer belt 12 downstream of the image forming station 7K in the conveyance direction of the intermediate transfer belt 12. The optical sensor 21 detects a position detection patch image to be used for color registration control, and a density control patch image. As shown in FIG. 2, the optical sensor 21 is arranged near each edge portion of the intermediate transfer belt 12 to detect patch images 500 formed there. FIG. 3 is a view showing the configuration of the optical sensor 21. The optical sensor 21 includes a light-emitting element 23 such as an LED, and a light-receiving element 24 such as a photodiode or CdS. Note that the light-receiving element 24 is arranged at a position where it receives diffuse reflection light from a measurement target but does not receive specular reflection light from the measurement target. In the example of FIG. 3, the light-emitting element 23 is arranged so as to emit a laser beam at an angle of 45° with respect to the normal to the intermediate transfer belt 12, and the light-receiving element 24 is arranged so as to receive the laser beam reflected in the direction of the normal to the intermediate transfer belt 12. If the patch image 500 is formed on the intermediate transfer belt 12, the light emitted by the light-emitting element 23 is reflected by the patch image 500. Of the reflected light which has reached the light-receiving element 24, diffuse reflection light is converted into an electric signal, and the light-receiving element 24 outputs a signal with an amplitude corresponding to the amount of the received light.

Figure 4:
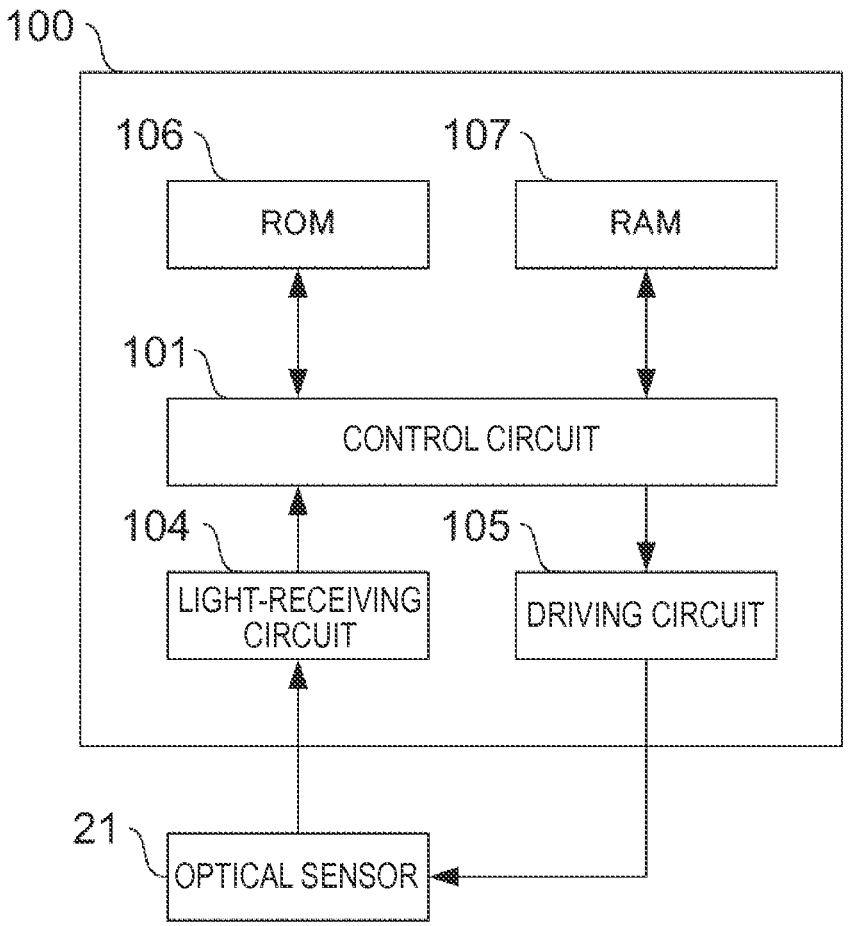
FIG. 4 is a block diagram showing the schematic arrangement of the control unit of the image forming apparatus according to an embodiment.

FIG. 4 is a block diagram showing the schematic arrangement of a control unit 100 of the image forming apparatus according to the present embodiment. Note that FIG. 4 shows only a portion associated with control of the optical sensor 21. A control circuit 101 controls the image forming unit 1 or the like based on control software or the like stored in a ROM 106. A RAM 107 is used to store various data and the like. A driving circuit 105 drives the light-emitting element 23 of the optical sensor 21 under the control of the control circuit 101. A light-receiving circuit 104 converts, into a voltage, an electric current corresponding to the amount of the received light output from the light-receiving element 24 of the optical sensor 21, and outputs it to the control circuit 101.

Figure 5A:
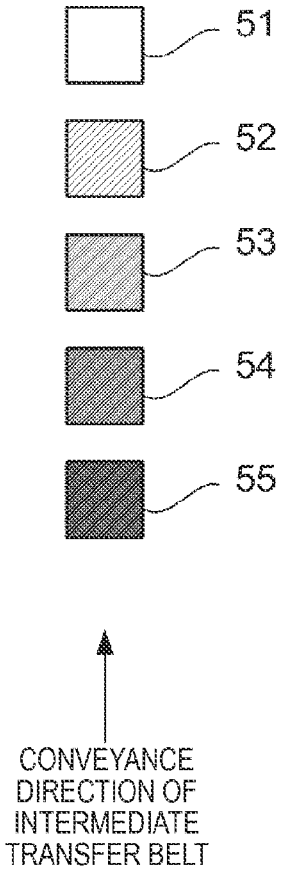
FIGS. 5A and 5B are views each showing an exemplary patch image.

In a density control operation, the control unit 100 forms, for each color, patch images 51 to 55 each having a certain tone, as shown in FIG. 5A. Note that data of the patch images have been stored in the ROM 106 or RAM 107. The patch images 51 to 55 with different densities are formed at a regular interval in the conveyance direction of the intermediate transfer belt 12, that is, the sub-scanning direction. As shown in FIG. 2, in the present embodiment, since the optical sensor 21 is provided at each edge of the intermediate transfer belt 12, a plurality of patch images for two of the four colors are formed on one side, and a plurality of patch images for the remaining two colors are formed on the other side. Note that although five patch images with different densities are formed for each color, the number of density levels is merely an example.

Figure 5B:
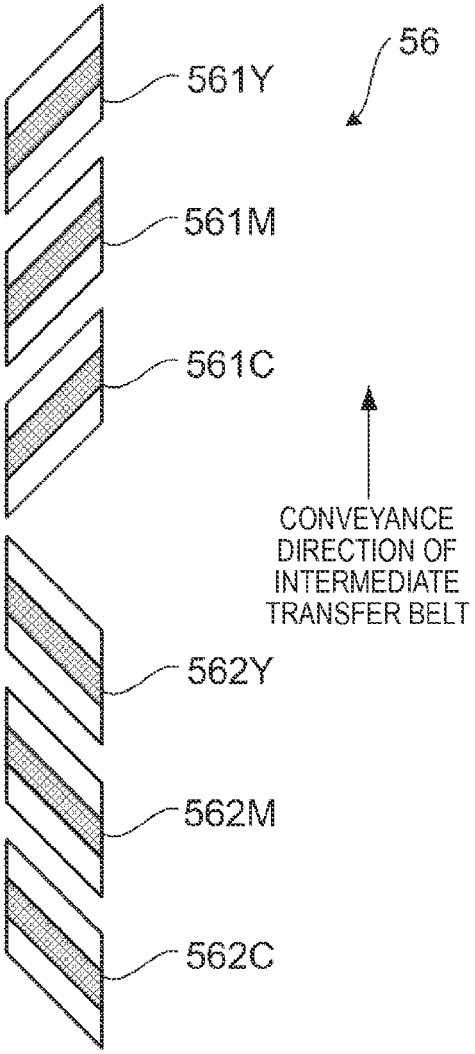

To perform a color registration adjustment operation, that is, an adjustment control operation for the position of each toner image, for example, as shown in FIG. 5B, parallelogram-shaped patch images 561Y, 561M, 561C, 562Y, 562M, and 562C for the respective colors except for black as a reference color are arranged in the sub-scanning direction. Note that these six patch images are formed at each edge of the intermediate transfer belt 12. Note also that the patch images 561Y and 562Y for yellow are used to detect the amount of the misregistration of a yellow toner image with reference to a black toner image. Similarly, the patch images 561M and 562M are used to detect the amount of the misregistration of a magenta toner image with reference to the black toner image, and the patch images 561C and 562C are used to detect the amount of the misregistration of a cyan toner image with reference to the black toner image. At this time, as shown in FIG. 5B, the patch images 561Y, 561M, and 561C are created to tilt by a predetermined angle with respect to the main scanning direction perpendicular to the sub-scanning direction. Furthermore, the patch images 562Y, 562M, and 562C are formed to be symmetrical to the patch images 561Y, 561M, and 561C with respect to a line in the main scanning direction.

Note that since the six patch images are different from each other only in terms of the color used and the arrangement direction, they will be simply referred to as patch images 56 if it is not necessary to discriminate between them. Each patch image 56 is obtained by superimposing a solid image with black toner as a reference on a solid image with corresponding color toner. Note that the black toner image indicated by a crosshatched portion in FIG. 5B is superimposed so as to divide the corresponding color toner region of each patch image 56 into two regions in the conveyance direction of the intermediate transfer belt 12. In the following description, a portion of the patch image 56, where the black toner image is superimposed, will be referred to as a black region, and the portion of a yellow, magenta, or cyan toner image will be referred to as a color region. Furthermore, among two color regions on two sides of the black region, a region on the leading side of the conveyance direction of the intermediate transfer belt 12 will be referred to as a leading-side color region, and a region on the trailing side will be referred to as a trailing-side color region. Assume in the following description that the leading side and trailing side indicate the downstream side and upstream side of the conveyance direction of the intermediate transfer belt 12, respectively.

Figure 6:
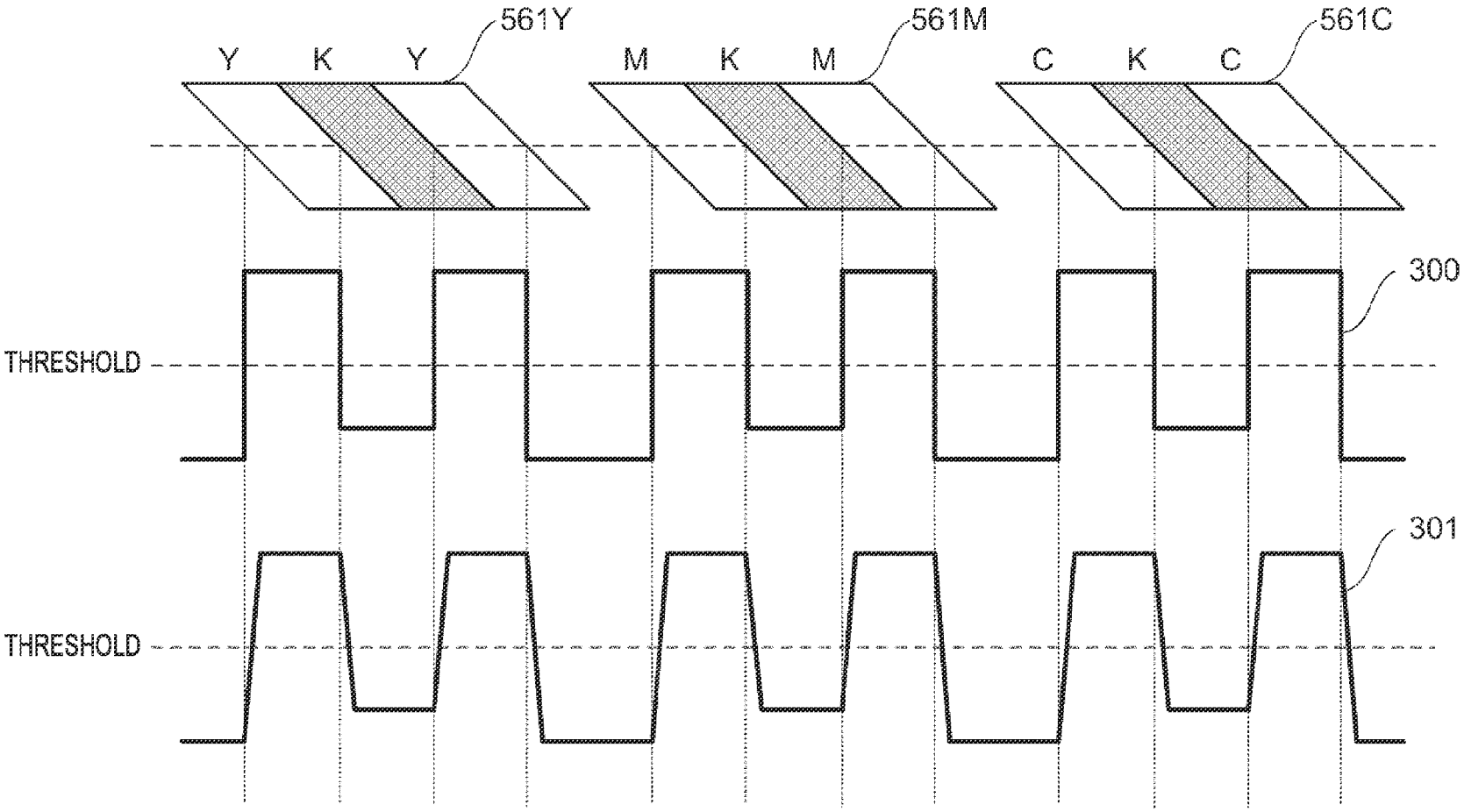
FIG. 6 is a view showing the output waveform of the optical sensor for position detection patch images.

FIG. 6 shows the output signal waveform of the optical sensor 21 according to movement of the patch images 56. An output signal waveform 300 represents an ideal output waveform, and an output signal waveform 301 represents an actual output waveform.

Light emitted by the light-emitting element 23 is reflected by the intermediate transfer belt 12 at a position where the patch image 56 is not formed on the intermediate transfer belt 12. Specular reflection light from the intermediate transfer belt 12 is strong, and diffuse reflection light from it is weak. Therefore, the amount of the light incident on the light-receiving element 24 at this time is very small. After that, if the position to which light is emitted by the light-emitting element 23 falls within the leading-side color region of the patch image 56 by movement of the intermediate transfer belt 12, the amount of diffuse reflection light becomes large, and the amount of light incident on the light-receiving element 24 increases. When the boundary portion between the leading-side color region and the black region of each patch image 56 reaches a position where light emitted by the light-emitting element 23 is reflected, the amount of received light detected by the light-receiving element 24 decreases. This is because the diffuse reflection light from the black toner image decreases. After that, when the boundary portion between the black region and the trailing-side color region is reached, the amount of received light detected by the light-receiving element 24 increases again. When the patch image 56 passes through the position where the light emitted by the light-emitting element 23 is reflected, by movement of the intermediate transfer belt 12, the amount of light incident on the light-receiving element 24 decreases.

The control circuit 101 of the control unit 100 compares the output value of the sensor 21 with a threshold. If the output of the sensor 21 is larger than the threshold, the control circuit 101 outputs high. If the output of the sensor 21 is smaller than the threshold, the control circuit 101 outputs low. When the amount of reflected light received by the light-receiving element 24 exceeds the threshold (at a timing of changing from low to high), or becomes smaller than the threshold (at a timing of changing from high to low), a position at this time is detected as the boundary of each region. The waveform 300 of FIG. 6 indicates the ideal waveform of the output of the light-receiving element 24, in which the rise time and fall time are substantially zero.

Figure 15A:
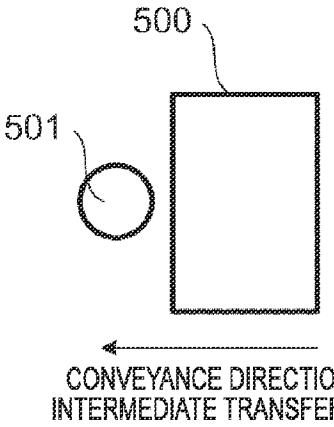
FIGS. 15A to 15D are views showing the relationship between a patch image and the output of an optical sensor.
Figure 15B:
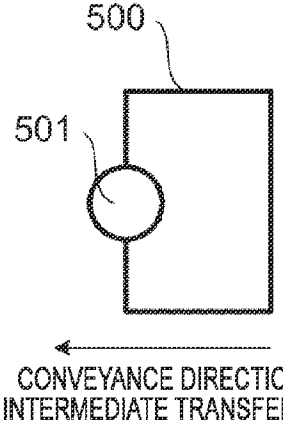
Figure 15C:
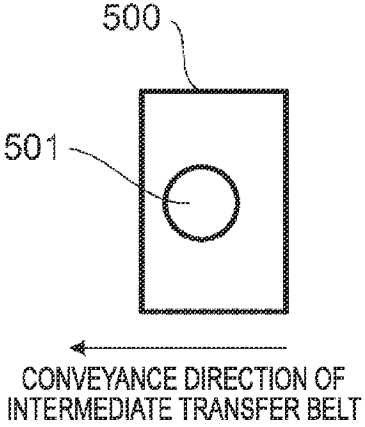
Figure 15D:
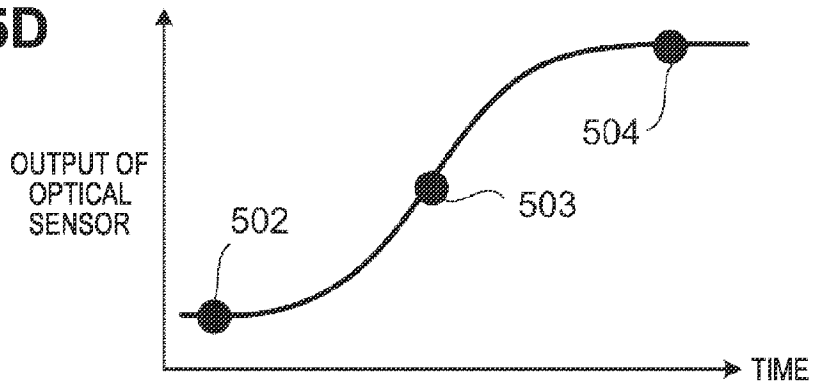

The signal waveform output from the light-receiving element 24 will be described with reference to FIGS. 15A to 15D. FIG. 15A shows a state in which a light spot 501 emitted by the light-emitting element 23 does not enter the patch image 500. FIG. 15B shows a state in which half the light spot 501 emitted by the light-emitting element 23 enters the patch image 500. Furthermore, FIG. 15C shows a state in which the whole light spot 501 emitted by the light-emitting element 23 enters the patch image 500. Note that the patch image 500 is assumed to be uniformly formed within a plane. FIG. 15D shows the output waveform of the light-receiving element 24. Points 502, 503, and 504 indicate the states shown in FIGS. 15A, 15B, and 15C, respectively. In the state shown in FIG. 15A, the patch image 500 has not reached the position of the light spot to obtain only diffuse reflection light from the surface of the intermediate transfer belt 12, and thus the output is not so large. Note that the intermediate transfer belt 12 of the present embodiment is black, and adjusts the volume resistance and surface resistance by dispersing a conductive material such as carbon black. In the state shown in FIG. 15B, the light spot gradually enters the patch image 500, and thus the amount of the reflected light gradually increases. Since the whole light spot is on the patch image in the state shown in FIG. 15C, the amount of the diffuse reflection light increases and thus a large output is obtained. In this manner, when the patch image 500 passes through the light spot, a change in diffuse reflection output occurs, thereby enabling detection of the edge position of the patch image 500. As described with reference to FIGS. 15A to 15D, the rise time and fall time are not zero for the actual signal output from the optical sensor 21, and a certain rise time and fall time are required. The waveform 301 of FIG. 6 indicates that the actual waveform output from the light-receiving element 24 requires a certain rise time and fall time.

As described above, the leading edge position and trailing edge position of a signal indicate the boundaries of each region. Furthermore, the high or low duration of a signal level indicates the width of each region of the patch image 56 in the sub-scanning direction.

As shown in FIG. 6, the black region is detected using the fact that when a black (Bk) pattern is superimposed on a color pattern, the diffuse reflection output of a background (intermediate transfer belt) portion becomes low, that of a color region becomes high, and that of the black region becomes low. It is possible to calculate the amount of the color misregistration in each of the main scanning direction and the sub-scanning direction depending on how much the relative positional relationship between the color pattern and the black (Bk) pattern shifts from the original relationship.

In the present embodiment, an operation of calculating the amount of the color misregistration and setting adjustment conditions for color registration adjustment is referred to as color registration control. The adjustment conditions for color registration adjustment are used in an image forming position control operation when forming an image based on input image data.

If, for example, the width of the leading-side color region of the patch image 561Y is equal to that of the trailing-side color region, it can be determined that there is no misregistration of yellow in the sub-scanning direction with reference to black as a reference color. On the other hand, if the two widths are different from each other, it can be determined that there is misregistration of yellow in the sub-scanning direction with reference to black as a reference color. Note that if the width of the leading-side color region is smaller than that of the trailing-side color region, yellow shifts in a direction opposite to the conveyance direction of the intermediate transfer belt with respect to black. To determine misregistration in the main scanning direction, the two patch images are formed for each color to have line symmetry in the main scanning direction. That is, for example, misregistration in the main scanning direction is determined based on the duration between the edge of the patch image 561Y and that of the patch image 562Y. Furthermore, this control operation is performed near two end portions in the thrust direction to detect a tilt with respect to the thrust direction, or the like.

As indicated by the output waveform 301, the rise time and fall time are not zero for the actual signal output from the optical sensor 21, and a certain rise time and fall time are required.

In the present embodiment, misregistration indicates relative misregistration of a color with respect to a reference color. If the fall speed and rise speed are equal to each other in each patch image 56, an error in detected position is cancelled not to have an influence on color registration control. Since each patch image 56 is formed on the same intermediate transfer belt 12, and is detected by the same optical sensor 21, similar influences given by the conveyance speed, the optical characteristics of the optical sensor 21, and the like are exerted on the patch images 56 for each color. If, therefore, the density of each region of each patch image 56 is constant, the fall speed and rise speed are equal to each other in the patch image 56. In this embodiment, density control is performed before color registration control.

Figure 7:
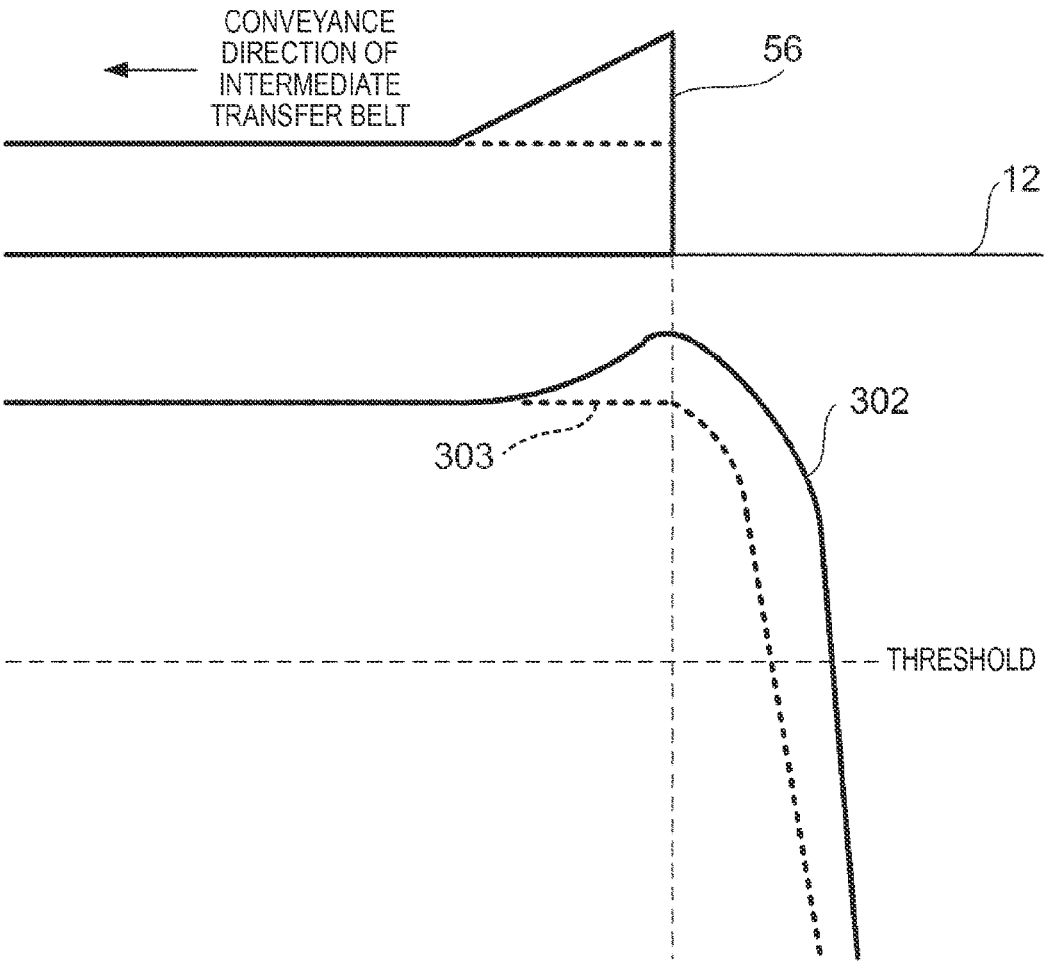
FIG. 7 is a view for explaining the occurrence of a detection error due to the edge density variation phenomenon.

Even if, however, density control is performed, an error occurs in a detected position when the edge density variation phenomenon in which the density is high in the edge of the patch image occurs. FIG. 7 shows the output signal of the optical sensor 21 when the edge density variation phenomenon occurs. As indicated by a waveform 303, if no edge density variation phenomenon occurs, the output of the optical sensor 21 starts to decrease at the trailing edge of the patch image 56. When, however, the edge density variation phenomenon occurs, the amount of applied toner increases at the edge of the patch image, as shown in FIG. 7. As the density of toner increases, therefore, the output of the optical sensor 21 accordingly increases temporarily, and then decreases, as indicated by a waveform 302. Consequently, the timing when the output becomes smaller than the threshold shifts, and an error occurs in a detected edge position.

If the rotation direction of the photosensitive member 3 is the same as that of the developing sleeve 41 like this embodiment, the edge density variation phenomenon mainly occurs at the edge of the electrostatic latent image formed on the photosensitive member 3 upstream of the rotation direction of the photosensitive member 3, as will be described below. That is, the phenomenon occurs at the trailing edge of the patch image.

Figure 8:
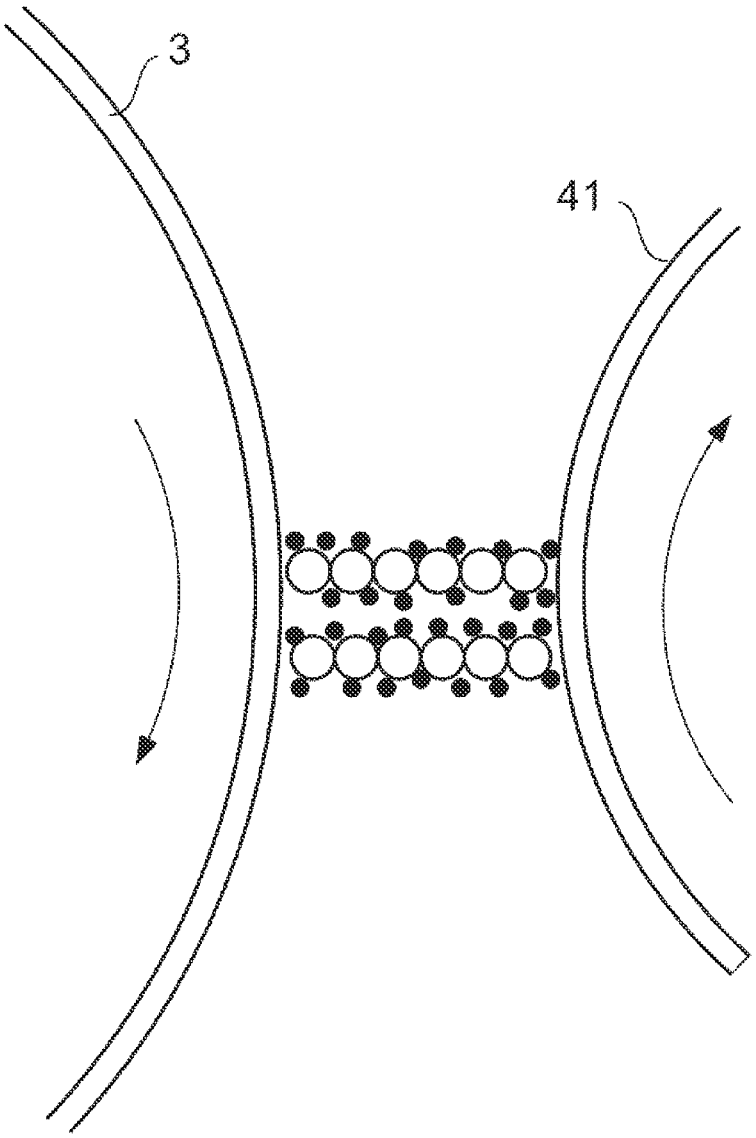
FIG. 8 is a view showing details of a development region.

The reason why the edge density variation phenomenon occurs in a reversal development method will be described with reference to FIGS. 8 and 9A to 9C. Note that the downstream side and upstream side of the rotation direction of the photosensitive member 3 will be referred to as the leading side and trailing side, respectively, in the following description. As shown in FIG. 8, in the development region where the photosensitive member 3 faces the developing sleeve 41, the developing sleeve 41 supplies nonmagnetic toner to the electrostatic latent image formed on the photosensitive member 3, thereby performing development. Note that referring to FIG. 8, an open circle represents magnetic carrier and a closed circle represents nonmagnetic toner.

Figure 9A:
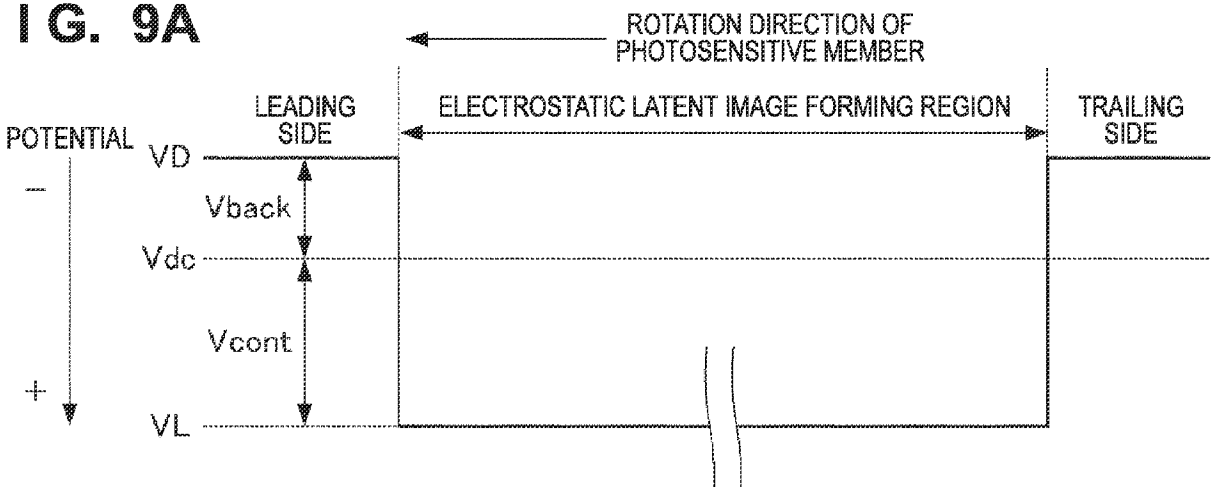
FIGS. 9A to 9C are views for explaining the occurrence of the edge density variation phenomenon.
Figure 9B:
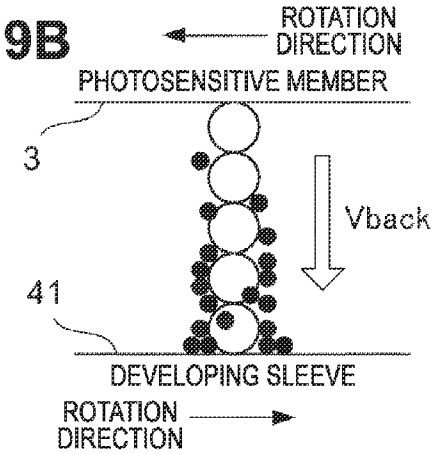
Figure 9C:
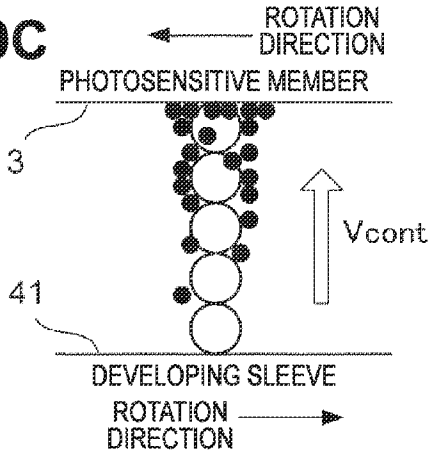

FIG. 9A shows an electrostatic latent image forming region (a region where an electrostatic latent image corresponding to the patch image 56 has been formed on the photosensitive member 3), and its potential states on the leading side and trailing side. Referring to FIG. 9A, reference symbol VD denotes a potential in a region which is not exposed, that is, a dark-portion potential; VL, a potential in a region (a region where the electrostatic latent image corresponding to the patch image 56 has been formed) which is exposed, that is, a bright-portion potential; and Vdc, the potential of the developing sleeve 41. If the electrostatic latent image on the photosensitive member 3 has not entered the development region, and the potential of the photosensitive member 3 is VD on the leading side of the electrostatic latent image forming region, negatively charged nonmagnetic toner moves to the developing sleeve 41 side by a back contrast potential Vback, as shown in FIG. 9B. In the development region, therefore, the amount of toner near the photosensitive member 3 is small, and that near the developing sleeve 41 is large. After that, when the electrostatic latent image enters the development region, and the potential of the photosensitive member 3 becomes VL, the negatively charged nonmagnetic toner moves to the photosensitive member 3 side by a contrast potential Vcont. In the development region, therefore, the amount of toner near the photosensitive member 3 is large, and that near the developing sleeve 41 is small. When the trailing edge of the electrostatic latent image reaches the development region, the toner is forced back to the developing sleeve 41 side by the back contrast potential. However, a lot of toner exists near the photosensitive member 3, and cannot wholly go back to the developing sleeve 41 side, and some toner remains at the trailing edge of the electrostatic latent image to be developed there. Therefore, the amount of applied toner become large near the trailing edge of the electrostatic latent image, thereby causing the edge density variation phenomenon on the trailing side.

Figure 10:
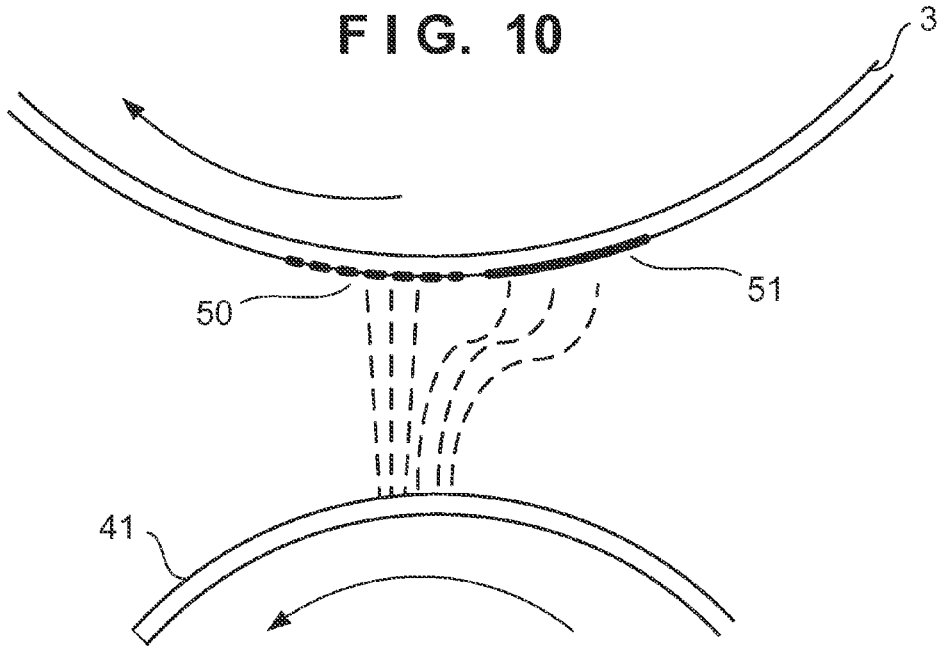
FIG. 10 is a view for explaining another example of the occurrence of the edge density variation phenomenon.

Note that even if the rotation direction of the photosensitive member 3 is opposite to that of the developing sleeve 41, that is, the surface of the photosensitive member 3 and that of the developing sleeve 41 which face each other move in the same direction in the development region, the edge density variation phenomenon occurs as will be described below. Referring to FIG. 10, reference numeral 50 denotes a region where a highlight image on the photosensitive member 3 has been formed; and 51, a region where a solid image has been formed. In this case, electric flux lines are attracted to the patch image 51. No toner is, therefore, supplied to the trailing portion of the highlight image 50, and highlight portions appear in the trailing portion of the highlight image 50. To the contrary, the density of toner becomes high in the edge portion of the solid image 51 adjacent to the highlight image 50.

The edge density variation phenomenon tends to occur when the developability of toner, that is, the mobility of toner drops due to degradation of the developer, a change in toner density, or the like, and it is thus impossible to cancel the contrast potential with the toner. That is, if the potential of toner developed on the photosensitive member 3 is equal to that of the developing sleeve 41, an electric field that moves negatively charged toner to the photosensitive member 3 is not applied. If, however, the developability drops, and the potential of toner developed on the photosensitive member 3 is not equal to that of the developing sleeve 41, toner at the trailing edge of the electrostatic latent image tends to move, thereby causing the edge density variation phenomenon. Since the developability changes by executing an image forming operation, the level of the edge density variation phenomenon also changes, and thus it is difficult to stabilize color registration control.

In the present embodiment, therefore, a signal waveform when the optical sensor 21 detects the position detection patch image 56 for each color in which no edge density variation phenomenon has occurred is acquired as a reference waveform in advance. An amplitude value at a predetermined position of each reference waveform is set as a reference value, and each reference waveform and its reference value are stored in the ROM 106 or RAM 107. After that, in color registration control, the optical sensor 21 detects each formed position detection patch image 56 to acquire its signal waveform (first signal), and the acquired signal waveform is compared with a reference waveform for a corresponding color or its reference value, thereby determining whether the edge density variation phenomenon has occurred. If the edge density variation phenomenon has occurred, a correction factor as a correction value is calculated based on the peak value of the acquired signal waveform and the reference value for the corresponding color, and the acquired signal waveform is corrected with the calculated correction value, thereby detecting the edge position by threshold determination. Note that in the present embodiment, a reference value Vref is an amplitude at a position where the output signal waveform of the optical sensor 21 starts to decrease at the trailing edge of the reference waveform or at a position immediately before that position.

Figure 11:
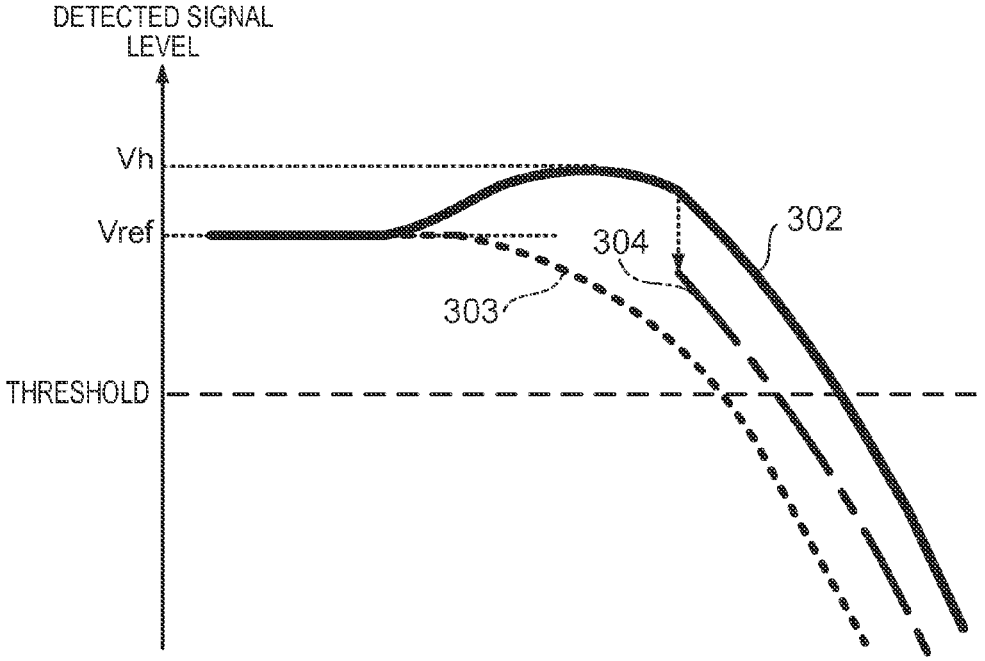
FIG. 11 is a view for explaining a correction factor according to an embodiment.

FIG. 11 is a view for explaining the correction factor. Referring to FIG. 11, the waveform 303 indicates the output signal of the optical sensor 21, that is, the reference waveform, when detecting the patch image 56 in which no edge density variation phenomenon has occurred. On the other hand, the waveform 302 indicates the output signal of the optical sensor 21 when detecting the patch image 56 in which the edge density variation phenomenon has occurred. Let Vh be a peak value in a portion where the signal level increases due to variation in density. As described above, the waveform 303 is stored by creating the patch image 56 in advance on the intermediate transfer belt 12, and sampling the amplitude value of the waveform upon detection by the optical sensor 21. For example, data for 1000 points sampled every 10 microseconds for 10 milliseconds immediately before the trailing edge are stored as reference waveform data. An amplitude value indicated by sampling data immediately before the amplitude value of the waveform starts to decrease is determined as a reference value.

The correction factor is represented by Vref/Vh. The control unit 100 multiplies each sampling value of the waveform 302 by the correction factor Vref/Vh to obtain a corrected waveform 304. The control unit 100 then performs threshold determination based on the corrected waveform 304 to detect the edge of the patch image 56. This can reduce the amount of an error in position. If, for example, Vh=1.77 and Vref=1.7, the correction factor is about 0.961. Assume that while the optical sensor 21 irradiates the surface of the intermediate transfer belt 12 on which no toner image is formed, the output of the optical sensor is 0.2. In this case, the value may be subtracted from Vh and Vref. More specifically, the correction factor is (1.7−0.2)/(1.77−0.2)=0.955. Furthermore, instead of multiplying the correction factor, Vh−Vref may be set as a correction value and the correction value may be subtracted from each value of the waveform 302.

Figure 12:
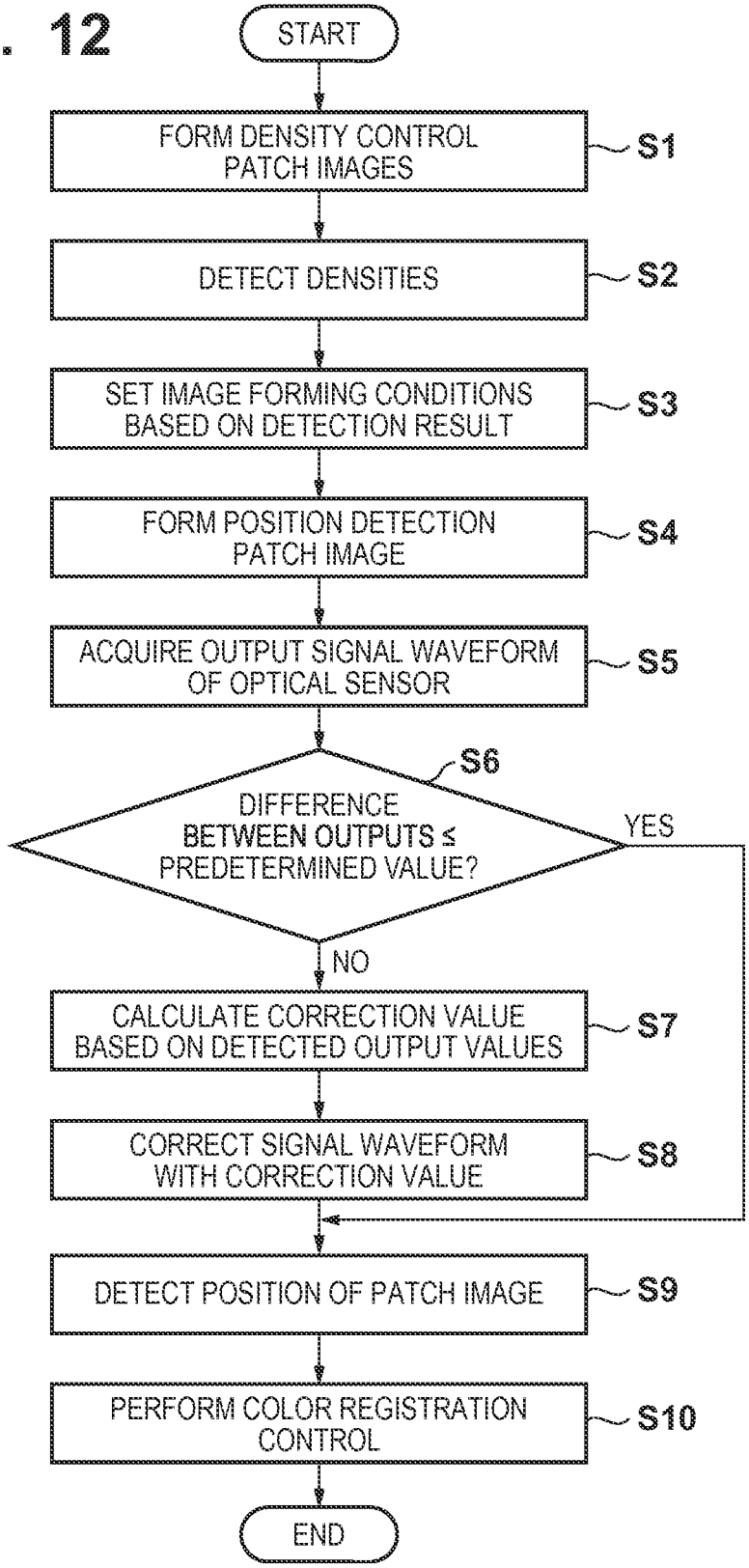
FIG. 12 is a flowchart illustrating density control and color registration control according to an embodiment.

Density control and color registration control executed by the control unit 100 will be described with reference to FIG. 12. Note that the control unit 100 executes density and color registration control at a predetermined timing, for example, upon power-on. In step S1, the control unit 100 controls the image forming unit to form, on the intermediate transfer belt 12, the density control patch images 51 to 55 described with reference to FIG. 5A. In step S2, the control unit 100 detects the densities of the patch images 51 to 55 based on the amount of light received by the optical sensor 21. In step S3, the control unit 100 sets image forming conditions, for example, such as exposure conditions and a contrast potential so that the difference between the detected density and a density to be formed becomes smaller. In step S4, the control unit 100 controls the image forming unit 1 to form each patch image 56 on the intermediate transfer belt 12.

In step S5, the control unit 100 acquires the signal waveform of each patch image 56 output from the optical sensor 21. In step S6, the control unit 100 determines whether the edge density variation phenomenon has occurred. More specifically, if the difference between the peak value Vh and the reference value Vref is equal to or smaller than a predetermined first value, it is determined that no edge density variation phenomenon has occurred; otherwise, it is determined that the edge density variation phenomenon has occurred. That is, if a value obtained by subtracting the reference value Vref from the peak value Vh is equal to or smaller than the predetermined first value, it is determined that no edge density variation phenomenon has occurred. If no edge density variation phenomenon has occurred, the control unit 100 determines the relative position of each patch image 56 with respect to black as a reference color by performing threshold determination, as usual in step S9. On the other hand, if the edge density variation phenomenon has occurred, the control unit 100 calculates a correction value based on the reference value Vref and the peak value Vh of the optical sensor 21 in step S7, and corrects the fall portion of the signal waveform with the calculated correction value in step S8, as described above. In step S9, the control unit 100 detects the relative position of each patch image 56 with respect to black as a reference color based on the corrected waveform. After that, the control unit 100 executes color registration control for each color based on the position of the color detected in step S9.

In step S6, it is determined based only on the difference between Vref and Vh whether the edge density variation phenomenon has occurred. The determination, however, may be made based on, for example, the difference between the reference waveform acquired in advance and a plurality of sampling values for a predetermined period of time before the signal waveform acquired in step S5 falls. The processing in step S6 may be omitted and the correction processing in step S7 may always be executed. Note that although the reference value is stored in advance in the above description, an amplitude value at a point of the acquired waveform immediately before the value starts to increase to the peak value due to the edge density variation phenomenon may be set as a reference value. That is, an amplitude value immediately before the amplitude starts to increase for a predetermined period of time of the signal waveform acquired in step S5 may be set as a reference value.

As described above, the density of each position detection patch image 56 is made constant by performing density control before color registration control. Furthermore, correcting the acquired waveform based on the reference value obtained in advance reduces an error in detected position which occurs due to the edge density variation phenomenon. This enables performance of color registration control with high accuracy.

(Second Embodiment)

Figure 13:
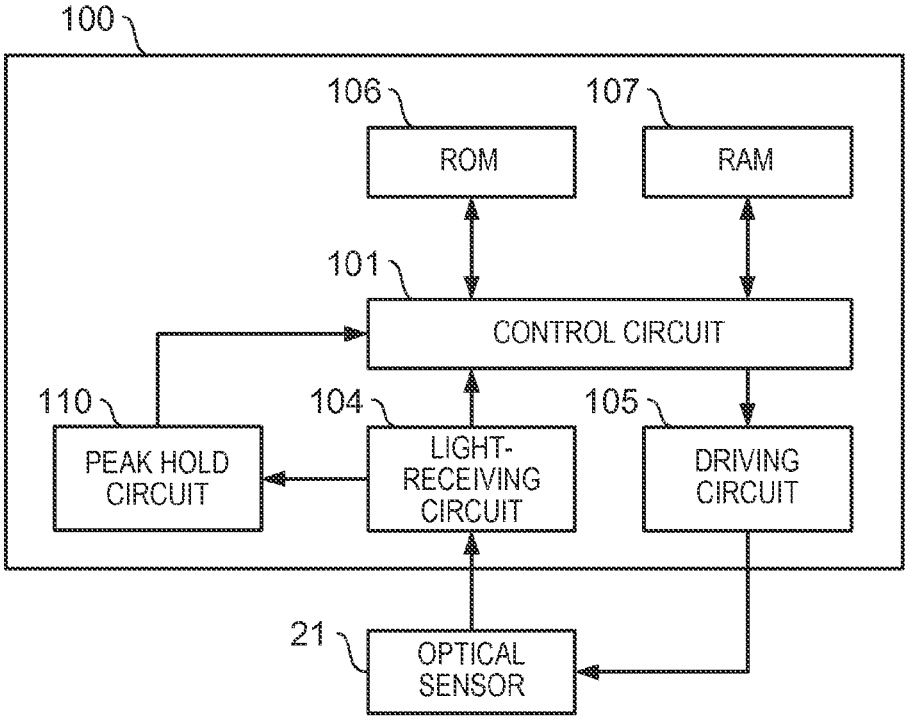
FIG. 13 is a block diagram showing the schematic arrangement of the control unit of an image forming apparatus according to an embodiment.
Figure 14:
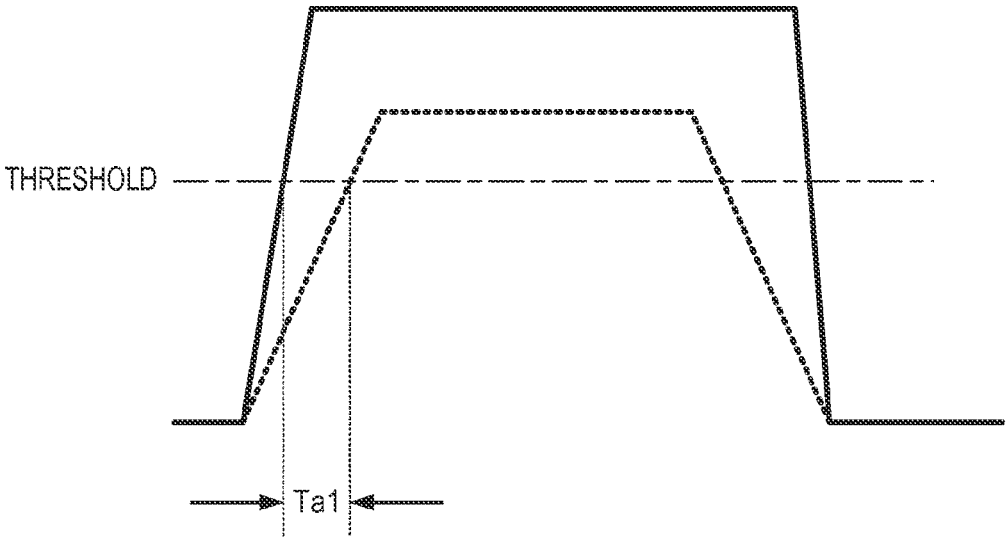
FIG. 14 is a view for explaining a case in which a detected position changes depending on the density of a patch image.

In the first embodiment, an amplitude at a point where the signal waveform obtained when no edge density variation phenomenon has occurred starts to fall is set as a reference value. In the second embodiment, a peak value when no edge density variation phenomenon has occurred is set as a reference value. Simultaneously to acquiring a signal waveform in the processing in step S5 of FIG. 12, a peak hold circuit detects the peak value of the signal waveform. FIG. 13 shows the arrangement of a control unit 100 according to the present embodiment. A different point from the first embodiment is that a peak hold circuit 110 for detecting the peak value of a signal waveform is arranged. Other components are the same as those in the first embodiment.

Note that in the above-described embodiment, the patch image 56 is obtained by superimposing a toner image with black as a reference color on that with color to undergo a position detection operation. A position detection patch image individually formed without superimposing a plurality of color toner images may be used. An optical sensor 21 may detect a patch image on a recording material serving as an image carrier rather than detecting the position of a patch image on an intermediate transfer belt 12.

(Other Embodiments)

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-286622, filed on Dec. 27, 2011, which is hereby incorporated by reference herein in its entirety.

What is claimed is:

1. An image forming apparatus comprising:

a plurality of image forming units configured to form images using an electrophotographic technique;

an image carrier onto which images formed by the plurality of image forming units are transferred;

a sensor configured to irradiate the image carrier with light, and detect reflected light;

a detection unit configured to detect, among output values of the sensor corresponding to one patch image, an output value of the sensor corresponding to a density varied edge area of the one patch image on the image carrier, the one patch image being formed on the image carrier by one of the image forming units, the density varied edge area being an area where densities of the one patch image are varied due to an edge density variation phenomenon;

a setting unit configured to set a correction condition based on the output value corresponding to the density varied edge area of the one patch image;

a determination unit configured to correct the output values of the sensor corresponding to the one patch image based on the correction condition, and determine a position of the patch image based on the corrected output values; and a color registration control unit configured to perform color registration control based on the determined position of the patch image.

2. The apparatus according to claim 1, wherein the sensor is further configured to receive diffuse reflection light from a measurement target, and the output value corresponding to the density varied edge area is a peak value of the output values of the sensor corresponding to the one patch image.

3. The apparatus according to claim 1, further comprising a storing unit configured to store a reference value, wherein the setting unit further configured to calculate the correction condition based on the output value corresponding to the density varied edge area and the reference value.

4. The apparatus according to claim 3, wherein the determination unit is further configured to determine, based on the reference value and the output value, whether to correct the output values of the sensor.

* * * * *